US008109758B2

(12) United States Patent
Kim

(10) Patent No.: US 8,109,758 B2
(45) Date of Patent: Feb. 7, 2012

(54) SYSTEM AND CONTROL METHOD FOR DETECTING AN ABNORMAL BURNING SITUATION USING AIR PRESSURE SENSING AND FLAME DETECTION

(75) Inventor: Si Hwan Kim, Incheon (KR)

(73) Assignee: Kyungdong Network Co., Ltd., Seoul (KR)

( * ) Notice: Subject to any disclaimer, the term of this patent is extended or adjusted under 35 U.S.C. 154(b) by 785 days.

(21) Appl. No.: 11/795,912

(22) PCT Filed: Sep. 14, 2005

(86) PCT No.: PCT/KR2005/003043
§ 371 (c)(1),
(2), (4) Date: Jul. 24, 2007

(87) PCT Pub. No.: WO2006/080612
PCT Pub. Date: Aug. 3, 2006

(65) Prior Publication Data

US 2008/0138750 A1 Jun. 12, 2008

(30) Foreign Application Priority Data

Jan. 28, 2005 (KR) ..... 10-2005-0007856

(51) Int. Cl.
*F23N 1/02* (2006.01)

(52) U.S. Cl. ..... 431/12; 431/75; 431/79; 431/90

(58) Field of Classification Search ..... 431/12, 431/75, 79, 89, 90
See application file for complete search history.

(56) References Cited

U.S. PATENT DOCUMENTS 4,457,692 A 7/1984 Erdman
(Continued)

FOREIGN PATENT DOCUMENTS

JP 62-245021 10/1987
(Continued)

OTHER PUBLICATIONS

English translation of JP 09-060867 (JP published Mar. 1997).*
(Continued)

*Primary Examiner* — Alfred Basichas
(74) *Attorney, Agent, or Firm* — Nelson Mullins Riley & Scarborough LLP; Anthony A. Laurentano

(57) ABSTRACT

Disclosed is a method for detecting a combustion state of a boiler, and more particularly to a boiler and a method capable of exactly detecting an abnormal combustion state of a gas boiler using an air pressure sensor and a flame detection unit, thereby improving efficiency of the boiler. The method comprises the steps of (S1) supplying air to a burner through a fan, (S2) detecting whether an optimum amount of air is supplied through step (S1) by using the air pressure sensor, (S3) continuously detecting a status of a flame through the flame detection unit if the flame is made by an ignition part, (S4) converting a size of the flame into a corresponding voltage value, inputting the voltage value into a microcomputer, and comparing the voltage value with a preset target voltage value, (S5) stopping a combustion process if the microcomputer determines that the air pressure sensor erroneously operates based on a fact that a difference value between the voltage value and the preset target voltage value exceeds a reference value, and (S6) displaying an error message indicating an abnormal combustion state if the microcomputer determines that the air pressure sensor erroneously operates.

5 Claims, 3 Drawing Sheets

U.S. PATENT DOCUMENTS

| | | | | | |
|---|---|---|---|---|---|
| 4,478,831 | A | | 10/1984 | Keller-Juslen et al. | |
| 5,245,196 | A | * | 9/1993 | Cabalfin | 250/554 |
| 5,300,836 | A | * | 4/1994 | Cha | 327/113 |
| 5,513,979 | A | * | 5/1996 | Pallek et al. | 431/90 |
| 5,658,140 | A | | 8/1997 | Kondou et al. | |
| 5,882,185 | A | | 3/1999 | Kim et al. | |
| 7,047,943 | B1 | | 5/2006 | Kanno | |

FOREIGN PATENT DOCUMENTS

| | | | |
|---|---|---|---|
| JP | 6-180117 | | 6/1994 |
| JP | 08-210637 | | 8/1996 |
| JP | 9-60867 | | 3/1997 |
| JP | 10-246433 | | 9/1998 |
| JP | 2002257338 | * | 9/2002 |
| KR | 1019960016352 | B1 | 12/1996 |
| KR | 100170179 | B1 | 10/1998 |
| KR | 100220715 | B1 | 6/1999 |
| KR | 100427390 | B1 | 4/2004 |

OTHER PUBLICATIONS

English translation of JP 10-246433 (JP published Sep. 1998).*

Japanese Office Action for Application No. 2007-553022, dated Feb. 15, 2011.

* cited by examiner

SYSTEM AND CONTROL METHOD FOR DETECTING AN ABNORMAL BURNING SITUATION USING AIR PRESSURE SENSING AND FLAME DETECTION

TECHNICAL FIELD

The present invention relates to a method for detecting a combustion state of a boiler, and more particularly to a system and a method capable of exactly detecting an abnormal combustion state of a gas boiler using an air pressure sensor and a flame detection unit, thereby improving efficiency of the boiler.

BACKGROUND ART

In general, boilers used for heating rooms or halls are classified into an oil boiler, a gas boiler, and an electric boiler according to kinds of fuel supplied to the boilers. The boilers have been variously developed and used corresponding to a size of a room or a hall desired by a user or their installation purpose. Among such boilers, it is very important for the gas boiler to maintain a normal combustion state by controlling an amount of air according to temperature variation of ambient air such that a predetermined amount of air can be constantly supplied thereto.

An air pressure sensor (APS) is mainly used in order to measure an amount of air desirable for the gas boiler. In particular, such an air pressure sensor plays an important role of controlling an amount of the air required for the combustion of the gas boiler because the air pressure sensor applies an electrical signal to a main controller including a microcomputer by detecting a pressure of air.

However, conventionally, a breakage or an error of the air pressure sensor cannot be appropriately determined, and there is no method for quickly coping with the breakage or the error of the air pressure sensor.

In detail, in order to detect the breakage or the error of the air pressure sensor, the RPM of a fan is determined by means of a hall sensor provided in a predetermined portion of the fan during a combustion process of the gas boiler, and then, detection voltage of the air pressure sensor according to the RPM of the fan is compared with a preset value. If the detection voltage is beyond the range of the preset value, it is determined that the breakage or the error of the air pressure sensor occurs, so the combustion process of the boiler is stopped, and errors are displayed.

However, the RPM of the fan varies depending on an installation condition (for example, the length of the funnel) of the gas boiler, and, since the RPM of the fan may vary depending on external conditions thereof (such as, wind), the range of the RPM for determining the breakage of the air pressure sensor is expanded, so that it is difficult to exactly determine the breakage or the error of the air pressure sensor.

As a result, when the air pressure sensor is broken or fails, the optimum amount of air required for the combustion process is not supplied to the boiler, so unstable combustion of the boiler results. Accordingly, carbon monoxide (CO) may be excessively exhausted, or a status of a flame may be worsened.

DISCLOSURE OF INVENTION

Technical Problem

For this reason, it may be difficult to control a temperature of the gas boiler, and gas may be unnecessarily consumed.

These problems of the conventional technique may degrade an overall efficiency of the gas boiler.

Therefore, the present invention has been made in view of the above-mentioned problems, and it is an object of the present invention to provide a boiler and a method for controlling the same, capable of exactly detecting an abnormal combustion state using an air pressure sensor (APS) and a flame detecting unit.

Technical Solution

To accomplish the above objects, there is provided a boiler for detecting an abnormal combustion state, the boiler including a burner arranged in a predetermined closed space, a fan installed at one side of the burner so as to supply air required for combustion, an air pressure sensor positioned at a predetermined portion of the fan so as to detect an amount of the supplied air, an ignition part provided at a bottom of the burner so as to make flames, a flame detection unit provided in the burner so as to detect the flames, and a microcomputer for outputting a variety of control signals by receiving electrical signals from the air pressure sensor and the flame detection unit.

The flame detection unit includes a frame rod, which is provided at one side of the burner so as to detect sizes of the flames by directly making contact with the flames.

The frame rod includes a metal having a superior conductivity.

The flame detection unit includes an infrared sensor, which is provided at a remaining side of the burner so as to detect the flames.

The infrared sensor includes a phototransistor representing different output voltage values according to sizes of the flames.

According to an aspect of the present invention, there is provided a method for controlling a boiler, which detects an abnormal combustion state using an air pressure sensor and a flame detection unit, the method including the steps of (S1) supplying air to a burner through a fan, (S2) detecting whether an optimum amount of air is supplied through step (S1) by using the air pressure sensor, (S3) continuously detecting a status of a flame through the flame detection unit if the flame is made by an ignition part, (S4) converting a size of the flame into a corresponding voltage value, inputting the voltage value into a microcomputer, and comparing the voltage value with a preset target voltage value, (S5) stopping a combustion process if the microcomputer determines that the air pressure sensor erroneously operates based on a fact that a difference value between the voltage value and the preset target voltage value exceeds a reference value, and (S6) displaying an error message indicating an abnormal combustion state if the microcomputer determines that the air pressure sensor erroneously operates.

Step (S3) comprises the steps of (S3*a*) selecting a frame rod scheme in which the flame detection unit directly makes contact with the flame, (S3*b*) selecting an infrared sensor scheme in which the flame detection unit detects the flame based on a calorie of the flame, and (S3*c*) selectively employing any one of the frame rod scheme and the infrared scheme or both the frame rod scheme and the infrared scheme and setting the selected scheme in a program.

The method further includes a step of preparing predetermined values corresponding to a calorie of the flame (kcal), current (mA), voltage (V), and combustion stopping due to excessive air or insufficient air in the form of a table and setting the table in the microcomputer.

Step (S5) comprises the steps of (S5*a*) determining whether or not a signal detected by the flame detection unit corresponds to an allowable error range of the target voltage value according to a calorie, which is set by a user, (S5*b*) determining that the flame detection unit normally operates if the detected signal corresponds to the allowable error range, and (S5*c*) continuously determining whether or not the detected signal corresponds to the allowable error range for a predetermined time if the detected signal deviates from the allowable error range in step S5*b*, and stopping the combustion process if it is determined that the detected signal deviates from the target value even when the predetermined time lapses.

Advantageous Effects

As described above, according to the present invention, since a hall sensor is not employed, it is possible to reduce manufacturing costs.

In addition, the present invention can detect the breakage or the error of an air pressure sensor by directly sensing a combustion state of a boiler, so that it is possible to more exactly detect the breakage or the error of an air pressure sensor and to more stably operate the boiler.

BEST MODE FOR CARRYING OUT THE INVENTION

Figure 1:
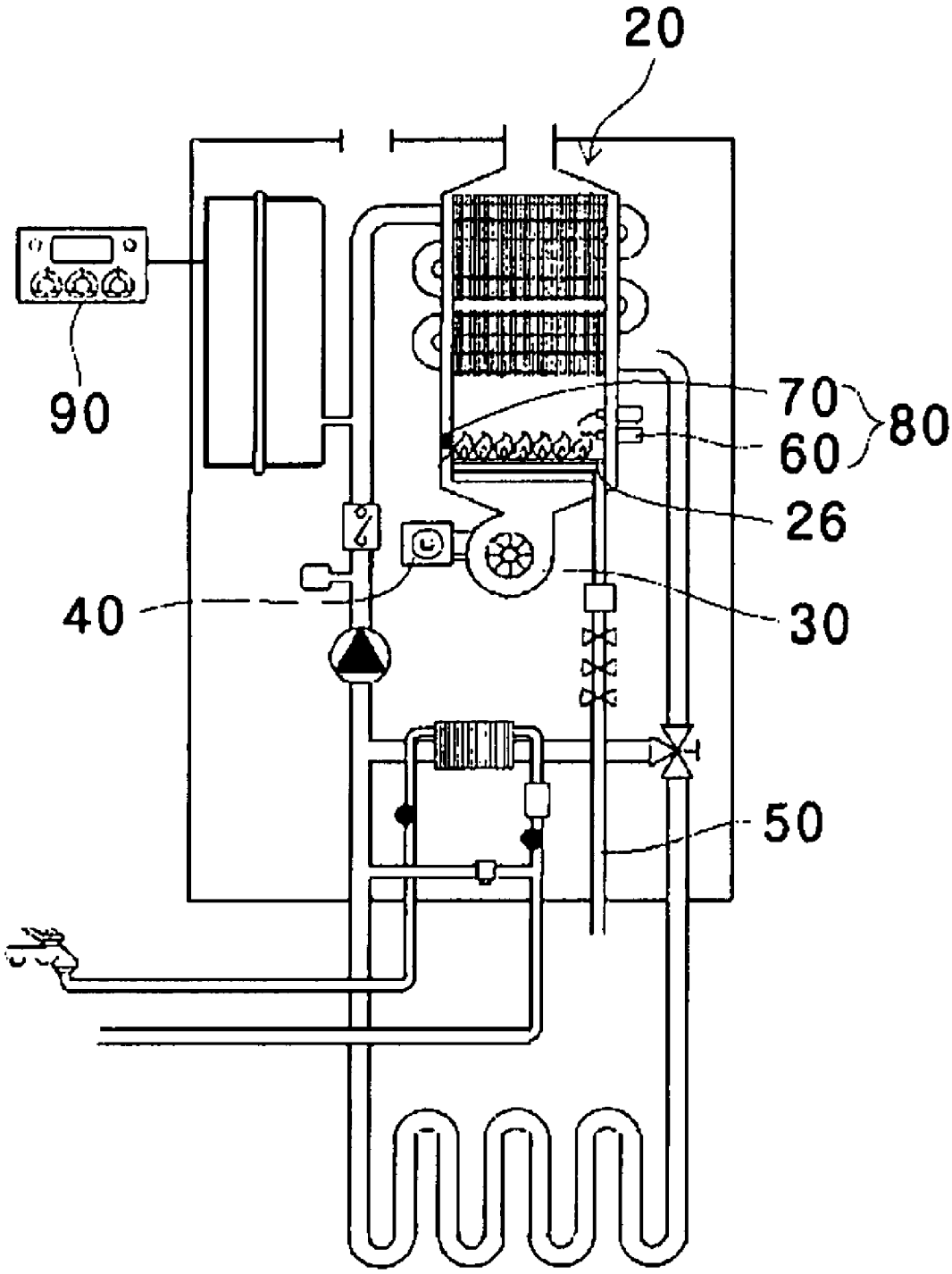
FIG. 1 is a sectional view illustrating an internal structure of a gas boiler according to the present invention.

FIG. 1 is a sectional view illustrating an internal structure of a gas boiler 10. Hereinafter, description will be made while focusing on main elements of the present invention, which are used for stably controlling a combustion state of the gas boiler 10 by controlling an amount of air.

The gas boiler 10 according to the present invention includes a burner 20 arranged in a predetermined closed space, a fan 30 installed at one side of the burner 20 so as to supply air required for a combustion process, and an air pressure sensor (APS) 40 provided at a predetermined portion of the fan 30 so as to detect an amount of the supplied air. An ignition part 26, which is connected to a gas supplying tube 50 so as to make flames 22 during the combustion process, is provided at a bottom surface of the burner 20. Meanwhile, a flame detection unit 80 is prepared in the burner 20. In detail, a frame rod 60, which is a first flame detection unit directly making contact with the flames 22 so as to detect the flames 22, is installed at one side of the burner 20 while being upwardly spaced from the ignition part 26 with a predetermined interval, and an infrared sensor 70, which is a second flame detection unit, is arranged at the other side of the burner 20. The infrared sensor 70 is aligned substantially parallel to the frame rod 60 so as to exactly detect the flames 22.

Preferably, the frame rod 60 includes a typical metal rod having a superior conductivity, and the infrared sensor 70 includes a phototransistor representing different output values according to calories of the flames 22. In addition, the operation of the gas boiler 10 according to the present invention is totally controlled by means of a controller 90.

Figure 2:
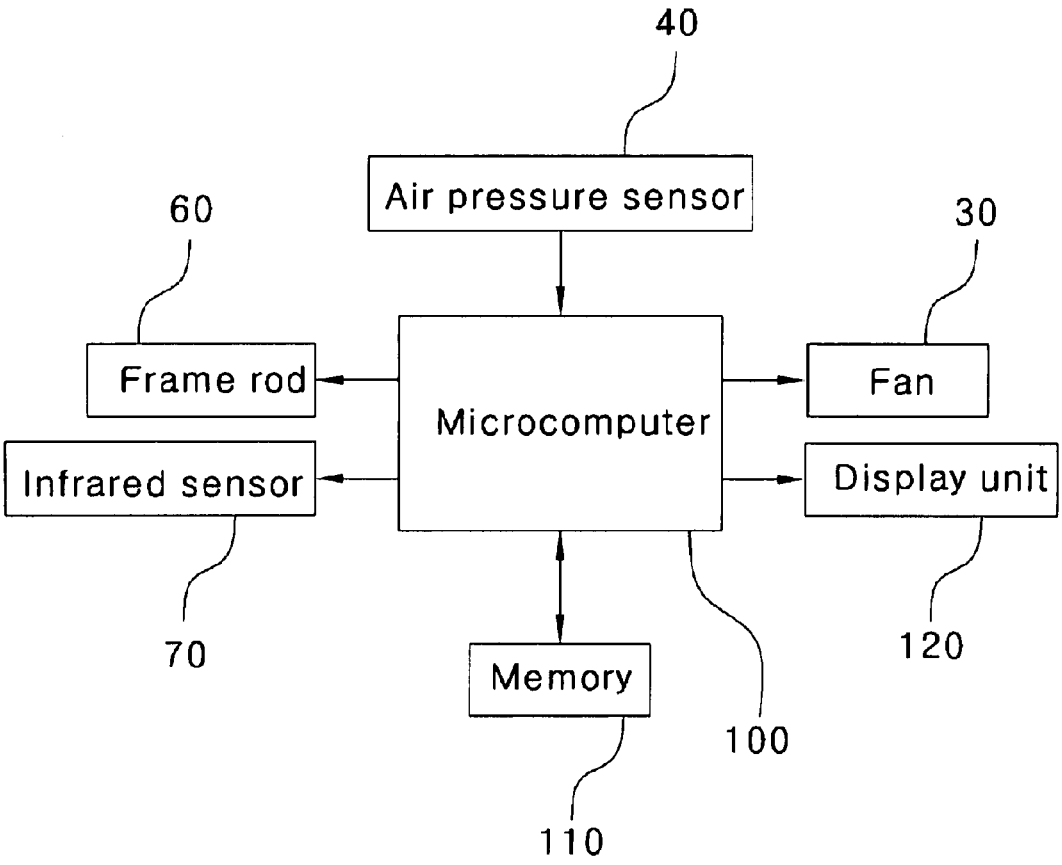
FIG. 2 is a block diagram illustrating a structure of a system for detecting an abnormal combustion state according to the present invention.

Referring to FIGS. 1 and 2, the gas boiler 10 according to the present invention includes the frame rod 60, which has a metal rod shape and serves as the first detection unit mounted on one side of the burner 20 so as to detect the flames 22, the infrared sensor 70, which is the second detection unit mounted on the other side of the burner 20 so as to more exactly detect the flames 22, the air pressure sensor 40, which detects an amount of air supplied to the burner 20, a microcomputer 100, which receives electric signals of the air pressure sensor 40, the frame rod 60, and the infrared sensor 70, compares data values set by a user with the electric signals, and outputs a variety of control signals, the fan 30, which rotates by receiving the control signal from an output unit of the microcomputer 100, and a display unit 120 for displaying an error signal upon the unstable combustion. In addition, the boiler 10 includes a memory 110, which stores various operation values obtained through the microcomputer 100.

Hereinafter, the operation of the flame detection unit, that is, operations of both the frame rod 60 and the infrared sensor 70 will be described in more detail.

The frame rod 60 has a metal rod shape and is constructed on the basis of the characteristic that the flame enables current to flow along the flame. That is, the frame rod 60 directly detects the flames 22 based on the current, which is applied to the frame rod 60 while being guided by the flames. As a result, an amount of current varies depending on amount of the flames 22 (that is, an amount of flames making contact with the metal rod), so different voltage is input into the microcomputer 100 depending on the amount of flames. Accordingly, the frame rod 60 may detect an unstable combustion state.

That is, if air is excessively supplied due to the breakage or the error of the air pressure sensor 40, the size of the flames 22 becomes small, so the current applied to the metal rod guided by the flames 22 becomes small. Accordingly, voltage input into the microcomputer 100 becomes small. In contrast, if air is insufficiently supplied, the flames 22 become long. Accordingly, the current applied to the metal rod guided by the flames 22 becomes large, so the voltage input into the microcomputer 100 becomes large. Thus, it is possible to more exactly determine the breakage or the error of the air pressure sensor 40.

Hereinafter, the operation of the infrared sensor, that is, the phototransistor will be described.

In order to detect the breakage or the error of the air pressure sensor 40 using the phototransistor, reference voltage values based on both excessive air and insufficient air causing a flame state requiring the stop of the combustion process are prepared in the form of a table according to calories and the table is stored in the microcomputer 100. In this state, if the voltage value beyond the reference voltage value (that is, an abnormal voltage value) is input during the combustion process, the combustion process is stopped and simultaneously, error is displayed on the assumption that the air pressure sensor 40 abnormally operates.

Figure 3:
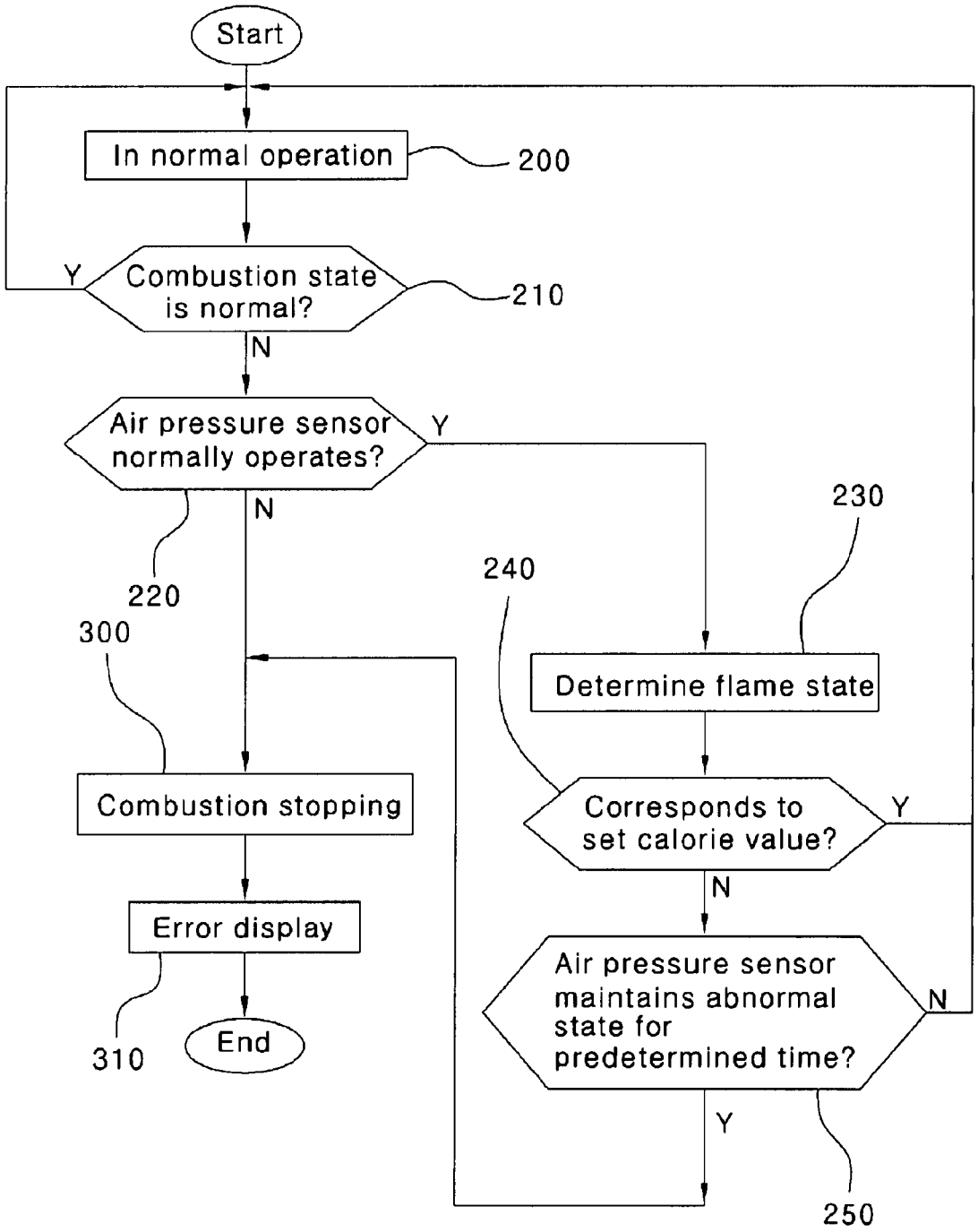
FIG. 3 is a flowchart illustrating a control procedure for detecting an abnormal combustion state according to the present invention.

Hereinafter, a method for controlling a flame detection procedure according to the present invention will be described in more detail with reference to FIGS. 1 to 3.

The microcomputer 100 determines whether or not the boiler 10 normally operates.

Among other things, the microcomputer 100 first checks whether or not the air pressure sensor 40 of the boiler 10 normally operates. If the microcomputer 100 determines that the air pressure sensor 40 does not normally operate, the microcomputer 100 displays errors in step 310 while stopping the combustion process in step 300. In contrast, if the microcomputer 100 determines that the air pressure sensor 40 normally operates, the microcomputer 100 checks whether or not a combustion state is normal in step 210. If the combustion state is normal, the microcomputer 100 determines that the boiler 10 normally operates (step 200). If it is determined that the combustion state is abnormal, the microcomputer 100 checks whether or not the combustion state is abnormal during a predetermined time and then displays errors in step 310 while stopping the combustion process in step 300.

In more detail, after the boiler 10 performs a combustion process through a predetermined step, it is determined whether or not the air pressure sensor 40 normally operates based on reference values stored in the microcomputer according to calories.

If it is determined that the air pressure sensor 40 does not normally operate and the air pressure sensor 60 maintains the abnormal state for a predetermined time, the combustion process is stopped, and errors are displayed. If the air pressure sensor 10 normally operates, the present combustion state, which is detected by the frame rod or the infrared sensor, is compared with the reference value stored in the microcomputer according to calories. The reference values are prepared on the basis of the excessive air or insufficient air causing the stop of the combustion process. If the value of the combustion state deviates from the reference values, it is determined that the boiler abnormally operates. Accordingly, it is determined whether or not the boiler is normal based on the reference values preset in the microcomputer. If it is determined that the value of the combustion state corresponds to the reference value, it is determined that the boiler normally operates. If it is determined that the value of the combustion state does not correspond to the reference value, it is checked whether this state maintains for a predetermined time (e.g., 5 seconds). If the above state maintains for the predetermined time, the combustion process is stopped in step 300. In contrast, if the value of the combustion state comes into the range of the reference value within the predetermined time due to the change of the value, it is determined that the boiler normally operates.

Therefore, the reference value corresponds to data values set in the microcomputer 100. In addition, if the detected value of the combustion state deviates from the allowable range of the reference value even when a predetermined time has lapsed, it is determined that the air pressure sensor 40 erroneously operates, so that the combustion process is stopped in step 300.

In the meantime, a user may selectively employ any one of the frame rod 60 and the infrared sensor 70. In addition, the user can employ both the frame rod 60 and the infrared sensor 70 so as to more exactly detect an abnormal state of the air pressure sensor 40, so that it is possible to improve efficiency of the boiler.

As described above, the abnormal operation of the air pressure sensor 40 is exactly detected by using the frame rod 60 or the infrared sensor 70, which serves as the flame detection unit 80, so that it is possible to more exactly detect data of the air pressure sensor 40 as compared with a conventional technique in which an erroneous operation of an air pressure sensor is determined by detecting an RPM of a fan using the hall sensor.

In addition, according to the present invention, since a hall sensor can be omitted, it is possible to reduce manufacturing costs. Furthermore, the frame rod 60 or the infrared sensor 70, which serves as the flame detection unit, can be used without providing additional device for realizing the present invention, so that it is possible to reduce manufacturing costs.

INDUSTRIAL APPLICABILITY

As described above, according to the present invention, it is possible to precisely detect an abnormal combustion state of the gas boiler using an air pressure sensor and a flame detection unit, so that the efficiency of the gas boiler can be improved.

The invention claimed is:

1. A boiler for detecting an abnormal combustion state, the boiler comprising:

a burner arranged in a predetermined closed space;

a fan installed at one side of the burner so as to supply air required for combustion;

an air pressure sensor positioned at a predetermined portion of the fan so as to detect an amount of the supplied air;

an ignition part provided at a bottom of the burner so as to make flames;

a flame detection unit provided in the burner so as to detect the flames; and a microcomputer for outputting a variety of control signals by receiving electrical signals from the air pressure sensor and the flame detection unit, in which the microcomputer is configured to first determine whether or not the air pressure sensor normally operates by comparing an electrical signal from the air pressure sensor with a first predetermined reference value stored in the microcomputer, thereafter an electrical signal from the flame detection unit presenting a present combustion state is compared with a second predetermined reference value stored in the microcomputer, wherein the reference values are a target value corresponding to calories of the flame, to thereby determine whether the combustion state is abnormal or not, wherein the flame detection unit includes an infrared sensor, which is provided at a side of the burner so as to detect the flames.

2. The boiler as claimed in claim 1, wherein the flame detection unit further includes a frame rod, which is provided at one side of the burner opposite the infrared sensor so as to detect sizes of the flames by directly making contact with the flames.

3. The boiler as claimed in claim 2, wherein the frame rod includes a metal having a superior conductivity.

4. The boiler as claimed in claim 1, wherein the infrared sensor includes a photo-transistor representing different output voltage values according to sizes of the flames.

5. The boiler as claimed in claim 1, wherein the microcomputer compares the signal from the flame detection unit with the second pre-determined reference value only after the microcomputer determines that the air pressure sensor is operating normally.

* * * * *